United States Patent [19]

Irwin

[11] 3,958,293

[45] May 25, 1976

[54] PIPE CLEANING MACHINE

[75] Inventor: Lawrence F. Irwin, Calabasas Park, Calif.

[73] Assignee: Augerscope, Inc., San Fernando, Calif.

[22] Filed: Aug. 26, 1974

[21] Appl. No.: 500,499

[52] U.S. Cl. ..... 15/104.3 SN
[51] Int. Cl.[2] ..... B08B 9/02
[58] Field of Search ..... 15/104.3 SN, 104.3 R

[56] References Cited

UNITED STATES PATENTS

| | | | |
|---|---|---|---|
| 2,245,823 | 6/1941 | Rappaport | 15/104.3 SN |
| 2,267,493 | 12/1941 | Clotz | 15/104.3 SN |
| 2,468,490 | 4/1949 | Di Joseph | 15/104.3 SN |
| 3,077,314 | 2/1963 | Caperton | 15/104.3 SN X |
| 3,095,592 | 7/1963 | Hunt | 15/104.3 SN |
| 3,120,017 | 2/1964 | Ciaccio | 15/104.3 SN |

*Primary Examiner*—Edward L. Roberts

[57] ABSTRACT

An improved pipe cleaning machine of the type which uses an elongated, flexible coil spring or plumbers snake formed of helically wound spring wire which is housed within a rotatable spring storage reel and is withdrawn therefrom for insertion into the pipe to be cleaned. The machine of the present invention embodies a novel one-piece rotatably driven spring storage reel or housing having a forward guide portion for guiding the dispensing and retraction of the spring and a rearwardly open spring storage portion. Extending into the rearwardly open reel and adapted for relative rotation therewith is an independently rotatable torque reaction element adapted to engage the spring and in cooperation with the reel, prevent the spring or snake from kinking or back-looping in response to torque build-up in the spring caused by the spring encountering an obstruction in the pipe being cleaned.

7 Claims, 11 Drawing Figures

54
32
24
26
56
64
58
62
4
4
31
66
60
63
68
70
7
7
28a
72
28
72
30
36
34
14
42
6
6
94
38
40
44
46
50
52
5
5
34
46
50
48
52
60
64
66

PIPE CLEANING MACHINE

BACKGROUND

1. Field of the Invention

This invention relates generally to pipe cleaning machines and more particularly to a power driven machine for storing and rotatively feeding and retracting flexible plumbers snakes or springs formed of helically wound spring wire.

2. Description of the Prior Art

Several types of hand and power driven pipe cleanout machines have been developed. One of the most successful is described in U.S. Pat. No. 3,095,592, issued to Robert G. Hunt. This machine embodied an independently rotatable combination torque reaction element and guide tube which extended into the storage reel from the front of the machine and cooperated therewith to guide the spring in and out of the storage reel and to prevent kinking thereof due to torque build-up.

As will become apparent from the discussion which follows, in the machine of the present invention, the forward portion of the one-piece storage reel performs the guiding function of the Hunt guide tube while the torque reaction element which is a separate element rotatably mounted within the reel performs the torque reaction function of the Hunt guide tube and cooperates with the storage reel to effectively prevent the spring from reverse looping. Additionally, since the torque reaction element is a separate element rotatably mounted on the frame and extending into the rearwardly open storage reel, the storage reel or cartridge can readily be demounted from the machine without interference. This enables the expeditious quick-change of reels, for example, to reels housing snakes of different sizes, without the necessity of the time-consuming and cumbersome removal of parts from the apparatus.

An additional advantage of the construction of the machine of the present invention is that when the machine is placed into a dwell, or non-feeding mode, the coil spring and the reel can be locked against relative rotation by merely adjusting a set screw carried by the forward or guide portion of the reel.

SUMMARY

It is an object of the invention to provide a new and significantly improved power driven pipe cleaning machine of the type which comprises an elongated, flexible coil spring or plumbers snake formed of helically wound spring wire which can be controllably withdrawn from the machine for insertion into the pipe to be cleaned.

It is another object to provide a novel one-piece storage reel or container which can be molded of plastic, rubber or the like, in which the coil spring can conveniently be housed. In the preferred form of the invention, the storage reel includes a generally annular shaped rear portion adapted to contain the spring in a coiled configuration and a novel integral forward guide portion configured so as to engage the spring during operation of the machine and closely guide its withdrawal from and reinsertion into the storage reel.

It is another object to provide a machine of the aforementioned character which embodies a unique torque reaction element adapted to cooperate with the storage reel to closely constrain the movement of the coil spring within the reel during operation of the machine so as to preclude kinking or reverse looping of the coil spring due to torque build-up therewithin.

It is still another object to provide a machine of the type described in the preceding paragraph in which the torque reaction element is rotatably mounted on the frame of the machine within the storage reel for rotation relative thereto and is so constructed and arranged as not to in any way interfere with the expeditious removal of the storage reel, thereby enabling a quick-change to another storage reel, for example, containing a coil spring of a different size.

Another object is to provide a machine which is lightweight, easy and inexpensive to manufacture and yet is extremely durable and reliable.

These and other objects of the invention are realized by a pipe cleaning machine of the type characterized by having an elongated flexible plumbers snake or spring formed of helically wound spring wire which is stored within the machine in a coiled configuration and can be withdrawn forwardly of the machine for insertion into the pipe to be cleaned, comprising: a frame, a one-piece spring housing rotatably mounted on the frame including; a generally annular shaped rear portion adapted to contain the spring in a coiled configuration; and a generally frustoconically shaped forward guide portion in communication with the rear portion and adapted to accommodate passage of the spring therethrough; a drive mechanism for rotating the spring housing; a torque reaction element cooperatively associated with the housing for engagement with the spring to guide the movement of the spring within the housing during its withdrawal from the machine, the element being rotatably mounted within the housing for relative rotation therewith about the axis of rotation thereof; and a feed mechanism mounted on the frame forwardly of the spring housing for receiving the spring as it passes forwardly through the guide portion of the spring housing and releasably gripping it to urge axial movement of the spring upon rotation of the housing.

DESCRIPTION OF ONE FORM OF THE INVENTION

Figure 1:
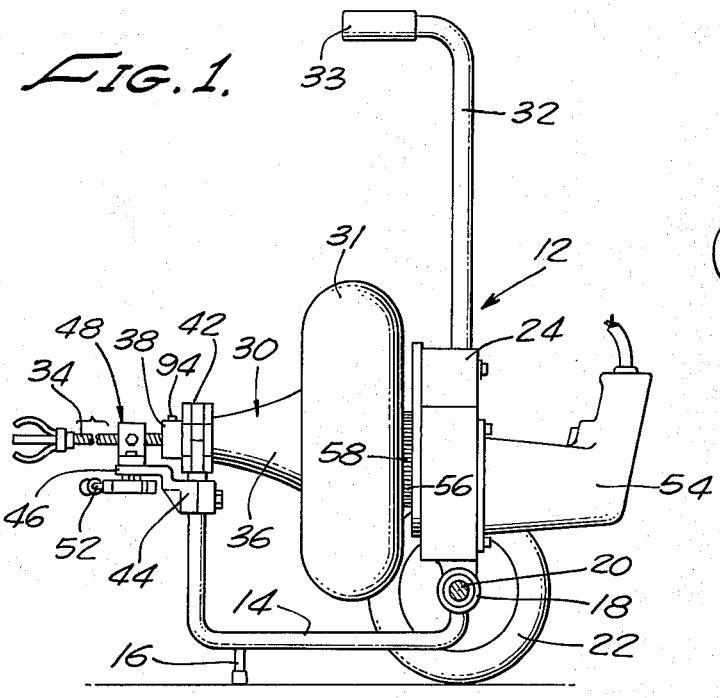
FIG. 1 is a side elevational view of a machine embodying the invention.
Figure 2:
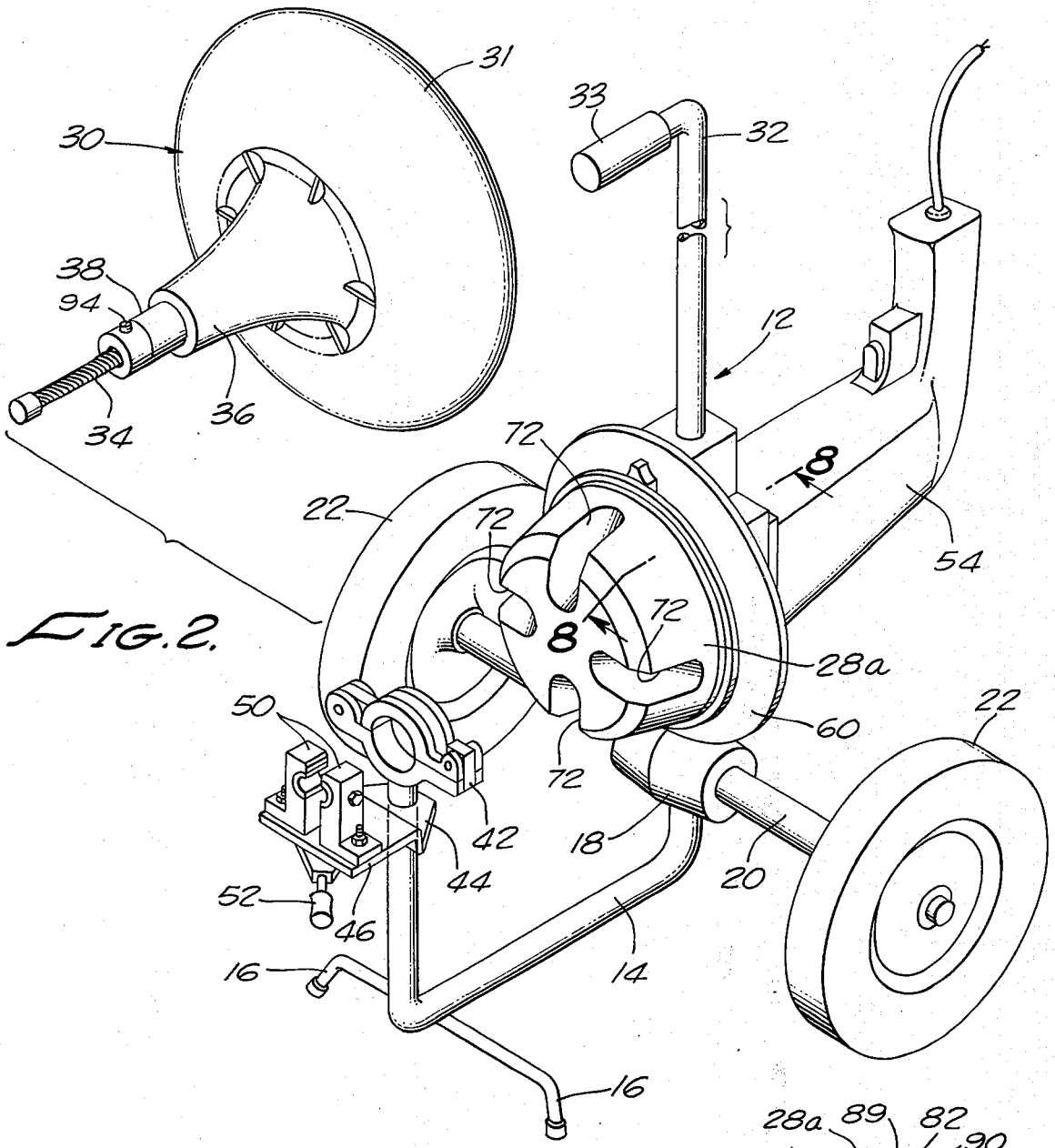
FIG. 2 is an exploded perspective view of the machine illustrating the construction of the torque reaction element and the manner in which the spring storage cartridge or reel containing the snake can readily be separated from the machine for replacement by another cartridge.
Figures 3, 4, 5:
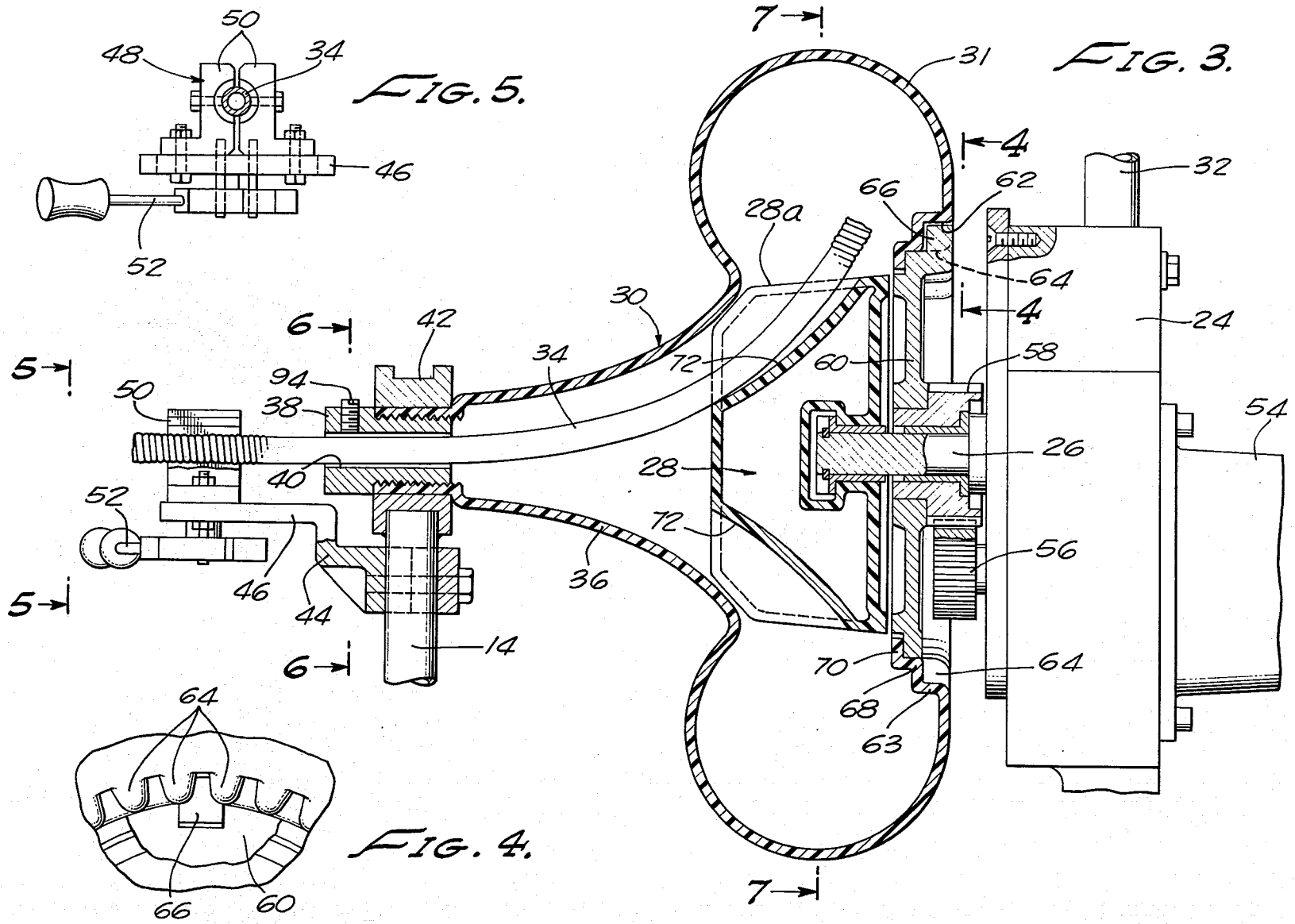
FIG. 3 is a fragmentary longitudinal cross-sectional view of the machine illustrating the internal construction and relative location of the cooperating component parts of the machine.
FIG. 4 is an enlarged fragmentary view taken along lines 4—4 of FIG. 3 showing the configuration of the teeth formed on the rearward opening in the reel and the manner of engagement therewith by the driving spur or tooth of the driving plate.
FIG. 5 is a view taken along lines 5—5 of FIG. 3 showing the construction of the spring feed mechanism of the machine.

Referring to the drawings and particularly to FIGS. 1 and 2, the machine includes a frame generally designated by the numeral 12. Frame 12 comprises a generally U-shaped tubular member 14 to which is affixed forward supporting legs 16. Also affixed to member 14 is an axle supporting hub 18 adapted to receive an axle 20 which carries wheels 22. Affixed to hub 18 and also forming a part of frame 12 is a support housing 24 on which, as shown in FIG. 3, is mounted a forwardly extending stub shaft 26. In a manner presently to be described, shaft 26 rotatably supports the torque reaction means 28 of the invention (FIGS. 2 and 3) as well as the spring housing or reel 30.

Extending upwardly from housing 24 is a tubular frame member 32 having a gripping portion 33. The construction of the frame of the machine is such that during operation, the machine stands on the wheels 22 and supporting legs 16, but it will be apparent that by tipping the device rearwardly and using frame member 32 as a handle, the machine may readily be wheeled.

As can best be seen by referring to FIG. 3, spring housing or reel 30 includes a generally annular shaped rear portion 31 adapted to contain a plumbers snake or spring 34 and a generally frustoconically shaped forward guide portion 36 in communication with rear portion 31 and adapted to accommodate passage of spring 34 therethrough. Forward guide portion 36 includes a threadably interconnected collar member 38 having an axial bore 40 through which snake 34 can pass. Reel 30 may be constructed of hard rubber, moldable plastic or other suitable lightweight, durable material.

Affixed to U-shaped member 14 at its forward extremity is a hinged bearing 42 which, when in a closed position as shown in FIGS. 2 and 3, rotatably supports the forward portion of reel 30 and holds the reel in coaxial alignment with stub shaft 26.

Also connected to U-shaped member 14 immediately below bearing 42 is a bracket 44 having a forwardly extending section 46 adapted to support the 2 means 48 of the apparatus. Feed means 48 receives the spring as it passes forwardly through the forward guide portion of the reel or spring housing and releasably grips it to urge axial movement of the spring upon rotation of the housing.

The feed means depicted in the drawings is similar to that shown and described in the U.S. Pat. to Hunt No. 3,095,592 and, as illustrated in FIGS. 2 and 5, comprises a pair of jaws 50 preferably being formed internally as half nuts to threadably engage the spring and permit the same to be advanced by rotating the snake relative to the jaws. Jaws 50 are mounted for limited movement toward and away from each other and may be moved out of engagement with the spring and into the configuration shown in FIG. 2 by movement of lever mechanism 52, the construction and operation of which is fully described in U.S. Pat. No. 3,095,592.

It is to be understood that various types of feed means can be used to engage the rotating spring so as to cause it to be advanced of the apparatus and it is not intended that the scope of the present invention be limited to the form of the feed means shown in the drawings and described in the patent to Hunt.

Figure 7:
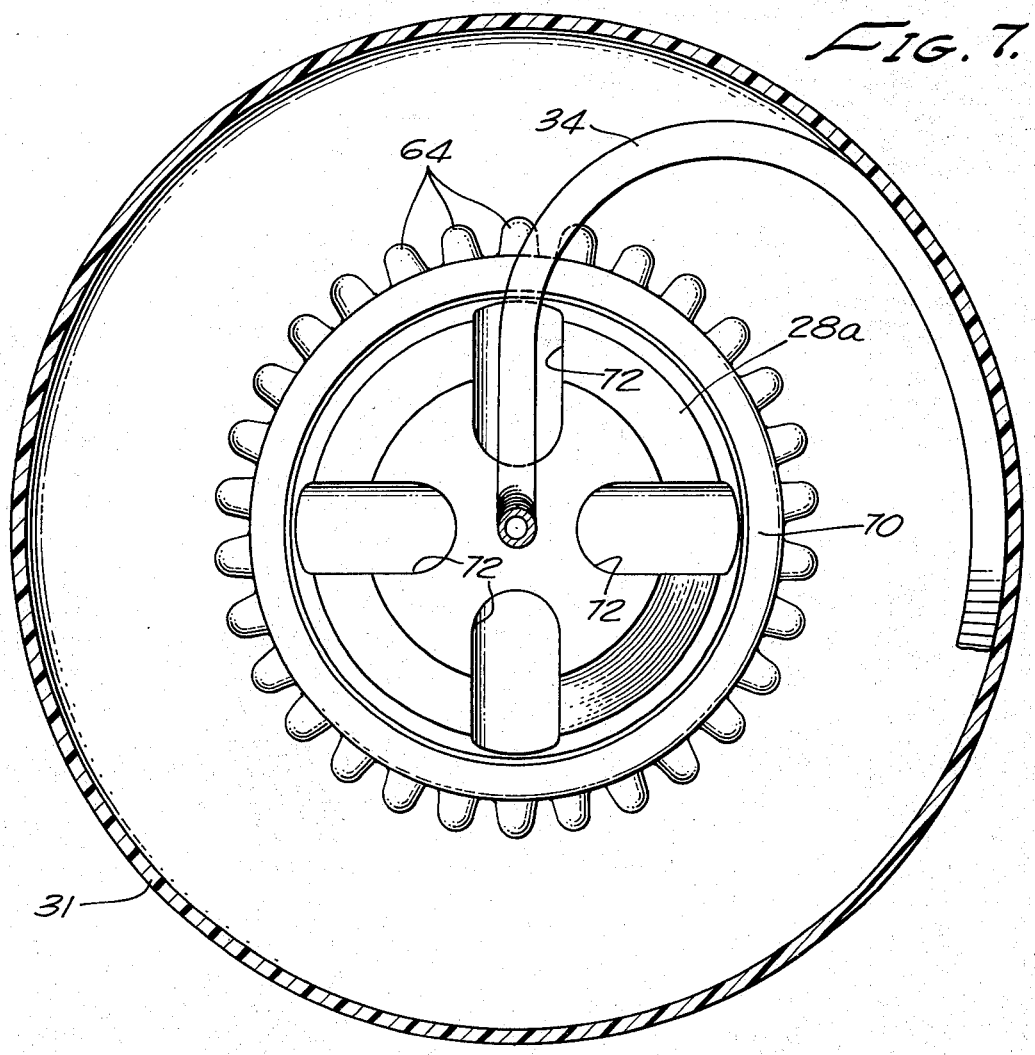
FIG. 7 is a view taken along lines 7—7 of FIG. 3 illustrating the cooperative interaction among the torque reaction element, the snake and the spring reel.

Turning again to FIGS. 1 and 3, the drive means of the invention for rotating the spring housing is shown here as comprising a rearwardly extending electric motor 54 carried by support housing 24 and a forwardly extending drive gear 56 also carried by housing 24. Drive gear 56 is driven by motor 54 through a suitable gear reduction mechanism carried within housing 24 (not shown), the design and construction of which is well understood by those skilled in the mechanical arts, and is adapted to drive a driven gear 58 rotatably carried by shaft 26. Affixed to driven gear 58 for rotation therewith about the axis of shaft 26 is a drive plate 60 which is removably receivable within an opening 62 formed in the rear wall of spring housing 30. As best seen in FIGS. 4 and 7, opening 62 is defined by a generally axially extending in-turned flange 63 which is provided with a multiplicity of circumferentially spaced apart radially inwardly extending tooth-like protrusions 64. Protrusions or teeth 64 are so constructed and arranged as to mate with a driving spur or tooth 66 (FIG. 4) provided at the periphery of drive plate 60. With this construction, rotation of gear 58 and drive plate 60 by driving gear 56 will cause concomitant rotation of spring housing 30 about the axis of shaft 26.

To locate spring housing 30 coaxially of the apparatus, a cylindrically shaped drive plate engaging section 68 (FIG. 3) is formed in the rear wall of the spring housing inwardly of wall 63. To locate the housing longitudinally of the apparatus, a radially inwardly extending drive plate engaging flange 70 is formed proximate the inner periphery of section 68. With this arrangement, when the reel is in place within the machine, the outer periphery of drive plate 60 engages section 68 and the forward face thereof engages flange 70.

An important feature of the present invention is the previously identified torque reaction means 28, the principal function of which is to continuously engage the snake or spring 34 as it feeds forwardly of the apparatus and, in cooperation with housing 30, prevent kinking or reverse looping of the snake due to torque build-up therein. The torque reaction means also serves to guide the spring into the rear or spring storage portion 31 of housing 30 when the spring is being retracted from the pipe by reverse rotation of the drive means.

Referring particularly to FIGS. 2 and 3, torque reaction means 28 of this embodiment of the invention is in the form of a generally frustoconically shaped element 28*a* rotatably mounted within reel 30 on stub shaft 26. Element 28*a* may be constructed of metal, hard rubber, moldable plastic or other suitable material and may be held in position on shaft 26 by the keeper ring and bearing arrangement shown in FIG. 3.

It is to be observed that the torque reactor element 28*a* is freely rotatable on shaft 26 and has a major diameter slightly smaller than the diameter of the rear opening in reel 30 so that reel 30 can conveniently be slipped over element 28*a* while the latter is interconnected with shaft 26. To interchange reels, therefore, all that is necessary is to release jaws 50 of the feed means, open hinged bearing 42, remove the reel by sliding it forwardly of the machine and then slide the new reel into place.

To operatively interact with the spring 34 which is housed within reel 30, element 28*a* is provided with at least one, and preferably with a plurality of axially extending circumferentially spaced apart spring receiving grooves or channels 72. As illustrated in FIGS. 3 and 7, these grooves guidably engage the outer periphery of the snake as it is withdrawn from or retracted into the storage reel. The advantage of providing several grooves within element 28*a* is that when a new reel is placed on the machine it need be rotated only a partial turn to permit the spring to automatically seat within one of the grooves.

It is to be appreciated that with the construction heretofore described, torque reaction element 28*a* is freely rotatable with respect to the spring housing or reel 30. Therefore, when the machine is operating in a normal feed mode, the forward feeding of the rotating snake longitudinally of the machine will cause rotation of the torque reaction element in the same direction as rotating reel 30. However, should the spring encounter a blockage within the pipe and become caught, so that it cannot rotate, continued rotation of reel 30 will cause a significant build-up of torque forces within spring 34. These force will be reflected back to the torque reaction element and, due to the construction of grooves 72, will urge counter-rotation thereof with respect to reel 30. In order to prevent backing looping of the spring under these conditions and to effectively constrain the spring between the torque reaction element and the walls of reel 30, it is necessary to provide a stop means for limiting counter-rotation of the torque reaction element or member 28*a*. In this form of the invention such means comprises a ratcheting means of the type illustrated in FIGS. 8–11. The ratcheting means permits relative rotation between torque reaction element 28*a* and reel 30 in one direction, but limits relative rotation in the opposite direction. Referring to these FIGS., it can be seen that the ratcheting means includes a generally cylindrically shaped stop member 76 extending through and rotatably carried by drive plate 60 near its periphery and a cooperating spring loaded assemblage 78 carried near the outer periphery of element 28*a*. Assemblage 78 comprises a generally cylindrical member 80 having a rounded head portion 82. Member 80 is reciprocatively movable within a cylindrical bore 84 formed in element 28*a* against the urging of a biasing means or spring 86 carried within bore 84. To hold member 80 captive within bore 84, a shoulder 88 is formed thereon proximate head 82. Shoulder 88 engages a shoulder 89 provided proximate the open end of bore 84 so as to limit the rearward travel of member 80 within the bore. Stop member 76 has a tapered face 90, a diametrically opposed axially extending flat portion 91 at its forward end, and is provided with a radially extending screwdriver slot 92 at its opposite end.

Figure 8:
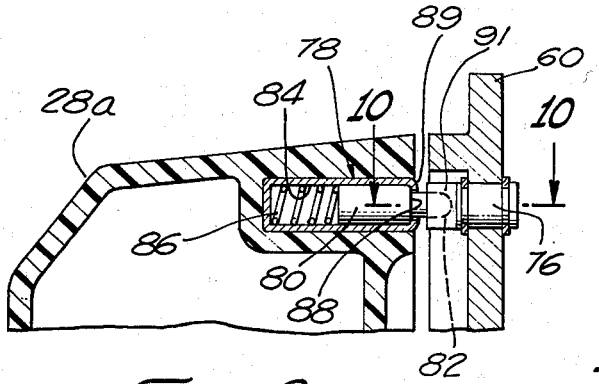
FIG. 8 is a cross-sectional view taken along lines 8—8 of FIG. 2 showing the construction of the racheting mechanism of the invention.
Figure 9:
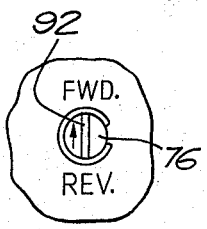
FIG. 9 is a fragmentary view illustrating the reversability feature of the racheting mechanism.
Figure 10:
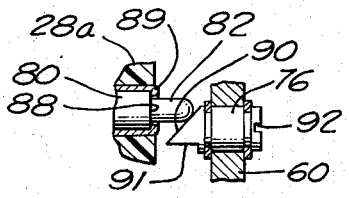
FIG. 10 is a view taken along lines 10—10 of FIG. 8 and, along with FIG. 11, further illustrates the construction of the racheting mechanism.
Figure 11:
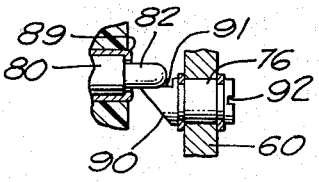

With the ratcheting means positioned as illustrated in FIGS. 8 and 10, rotation of plate 60 in a clockwise or feed direction (when viewed from the right or the rear of the machine) will permit element 28*a* to remain stationary or to rotate with plate 60 and reel 30 in a clockwise direction because upon rotation of plate 60 the tapered face 90 on member 76 will cause member 80 to telescope into bore 84 against the urging of spring 86. However, counter-rotation, i.e., rotation of element 28*a* in a counterclockwise rotation, will be limited by face 91 engaging head 82 of member 80. Under normal operating conditions, with the spring feeding forwardly of the machine, this setting of the ratcheting means will permit element 28*a* to rotate in a clockwise direction or to remain stationary with respect to plate 60. Should an obstruction be encountered, however, which would cause forces to be generated tending to rotate element 28*a* in a counterclockwise direction, such rotation will be limited by head 82 of member 80 moving into engagement with flat face 91 on member 76. As previously discussed, limiting the counter-rotation of element 28*a* under conditions of severe torque build-up within the spring will effectively constrain the spring between element 28*a* and reel 30 and prevent backlooping.

It will be appreciated that turning member 76 180° will permit rotation of element 28*a* and reel 30 in a counterclockwise direction to enable retraction of the spring.

Figure 6:
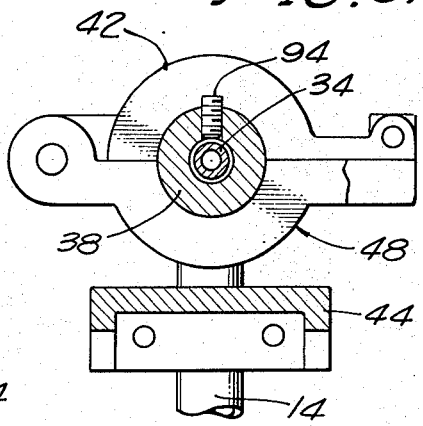
FIG. 6 is a view taken along lines 6—6 of FIG. 3 illustrating the construction of the hinged forward bearing which supports the guide portion of the reel.

Another feature of the present invention is the novel coupling means which enables easy interconnection of the reel and the spring to place the machine in a non-feeding or dwell mode. As previously discussed, during normal pipe cleaning operations, feeding and retracting of the spring is accomplished by rotation of the reel 30 with jaws 50 engaging the spring. However, under certain conditions, as when the spring meets an obstruction, it is advantageous to rotate the spring without feeding it forwardly. During this dwell mode it is desirable to be able to lock the reel and the spring together to prevent independent movement thereof. As illustrated in FIGS. 3 and 6, this is accomplished by a coupling means comprising in this embodiment a set screw 94 threadably carried by collar 38 of forward guide portion 36. By threading the set screw radially inwardly into engagement with the spring, the spring housing 30 and the spring can be quickly and effectively coupled together to prevent relative rotation thereof. By disengaging jaws 50 the apparatus can thusly be placed in a non-feeding dwell mode for stationary boring.

Having now described the invention in detail in accordance with the requirements of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A pipe cleaning machine of the type characterized by having an elongated flexible plumbers snake or spring formed by helically wound spring wire which is stored within the machine in a coiled configuration and can be withdrawn forwardly of the machine for insertion into the pipe to be cleaned, comprising:

a. a frame;

b. a one-piece spring housing rotatably mounted on said frame including;

1. a generally annular shaped rear portion adapted to contain the spring in a coiled configuration; and
2. a generally frustoconically shaped forward guide portion in communication with said rear portion and adapted to accommodate passage of the spring therethrough;

c. drive means for rotating said spring housing;

d. torque reaction means cooperatively associated with said housing for engagement with the spring to guide the movement of the spring within said housing during its withdrawal from the machine, said means being rotatably mounted within said housing for relative rotation therewith about the axis of rotation thereof and so constructed and arranged to cooperate with said housing during withdrawal of the spring to define a spring constraining passageway of a size to permit free passage of the spring but prevent the spring from kinking or backlooping in response to torque build-up therewith during withdrawal from the machine, said torque reaction means comprising a generally frustoconically shaped torque reaction element rotatably mounted on said frame within said housing said element being provided with at least one axially extending spring receiving groove for guidably engaging the spring; and e. feed means mounted on said frame forwardly of said spring housing for receiving the spring as it passes forwardly through the forward guide portion of said spring housing and releasably gripping it to urge axial movement of the spring upon rotation of said housing.

2. The pipe cleaning as defined in claim 1 including stop means for limiting counter-rotation of said element with respect to said spring housing.

3. The pipe cleaning machine as defined in claim 2 in which said stop means comprises a ratchet means for permitting rotation of said torque reaction element in the same direction as said spring housing, but limiting counter-rotation thereof.

4. A pipe cleaning machine of the type characterized by having an elongated flexible plumbers snake or spring formed of helically wound spring wire which is stored within the machine in a coiled configuration and can be withdrawn forwardly of the machine for insertion into the pipe to be cleaned, comprising:

a. a frame;

b. a one-piece spring housing rotatably mounted on said frame including;

1. a generally annular shaped rear portion adapted to contain the spring in a coiled configuration; and 2. a generally frustoconically shaped forward guide portion in communication with said rear portion and adapted to accommodate passage of the spring therethrough;

c. drive means for rotating said spring housing;

d. torque reaction means cooperatively associated with said housing for engagement with the spring to guide the movement of the spring within said housing during its withdrawal from the machine, said means being rotatably mounted within said housing for relative rotation therewith about the axis of rotation thereof and so constructed and arranged to cooperate with said housing during withdrawal of the spring to define a spring constraining passageway of a size to permit free passage of the spring but prevent the spring from kinking or backlooping in response to torque build-up therewith during withdrawal from the machine, said torque reaction means comprising a generally frustoconically shaped torque reaction element rotatably mounted on said frame within said housing, said element being provided with at least one axially extending spring receiving groove for guidably engaging the spring;

e. feed means mounted on said frame forwardly of said spring housing for receiving the spring as it passes forwardly through the forward guide portion of said spring housing and releasably gripping it to urge axial movement of the spring upon rotation of said housing; and f. coupling means for coupling together said spring housing and said spring to prevent relative rotation thereof.

5. The pipe cleaning machine as defined in claim 4 in which said coupling means comprises a set screw carried by said forward guide portion of said housing and movable in a radial direction into engagement with said spring.

6. A pipe cleaning machine of the type characterized by having an elongated flexible plumbers snake or spring formed of helically wound spring wire which is stored within the machine in a coiled configuration and can be withdrawn forwardly of the machine for insertion into the pipe to be cleaned, comprising:

a. a frame;

b. a one-piece spring housing rotatably mounted on said frame including;

1. a generally annular shaped rear portion adapted to contain the spring in a coiled configuration, said rear portion being provided with a multiplicity of circumferentially spaced apart radially inwardy extending teeth; and 2. a generally frustoconically shaped forward guide portion in communication with said rear portion and adapted to accommodate passage of the spring therethrough;

c. drive means for rotating said spring housing, said drive means comprising a rotatable drive plate carried by said frame having a driving tooth adapted to drivably engage the teeth of said spring housing for imparting rotational movement to said spring housing;

d. torque reaction means cooperatively associated with said housing for engagement with the spring to guide the movement of the spring within said housing during its withdrawal from the machine, said means being rotatably mounted within said housing for relative rotation therewith about the axis of rotation thereof and so constructed and arranged to cooperate with said housing during withdrawal of the spring to define a spring constraining passageway of a size to permit free passage of the spring but prevent the spring from kinking or backlooping in response to torque build-up therewith during withdrawal from the machine, said torque reaction means comprising a generally frustoconically shaped torque reaction element rotatably mounted on said frame within said housing, said element being provided with at least one axially extending spring receiving groove for guidably engaging the spring; and e. feed means mounted on said frame forwardly of said spring housing for receiving the spring as it passes forwardly through the forward guide portion of said spring housing and releasably gripping it to urge axial movement of the spring upon rotation of said housing.

7. A pipe cleaning machine of the type characterized by having an elongated flexible plumbers snake or spring formed of helically wound spring wire which is stored within the machine in a coiled configuration and can be withdrawn forwardly of the machine for insertion into the pipe to be cleaned, comprising:

a. a frame;

b. a one-piece spring housing rotatably mounted on said frame including;

1. a generally annular shaped rear portion adapted to contain the spring in a coiled configuration, said rear portion being rearwardly opening and having a multiplicity of circumferentially spaced apart driving teeth; and 2. a generally frustoconically shaped forward guide portion in communication with said rear portion and adapted to accommodate passage of the spring therethrough;

c. drive means for rotating said spring housing, said drive means comprising:

1. a generally circular driving plate rotatably carried by said frame and receivable within the rearward opening in said spring housing; and 2. a driving tooth provided at the periphery of said driving plate so constructed and arranged as to drivably engage said driving teeth of said spring housing;

d. torque reaction means cooperatively associated with said housing for engagement with the spring to guide the movement of the spring within said housing during its withdrawal from the machine, said means comprising a generally frustoconically shaped member rotatably mounted on said frame within said housing for relative rotation therewith about the axis of rotation thereof, and having at least one axially extending peripheral groove adapted to guidably engage said spring; and e. feed means mounted on said frame forwardly of said spring housing for receiving the spring as it passes forwardly through the forward guide portion of said spring housing and releasably gripping it to urge axial movement of the spring upon rotation of said housing.

* * * * *